US006722650B1

(12) United States Patent
Abbata et al.

(10) Patent No.: US 6,722,650 B1
(45) Date of Patent: Apr. 20, 2004

(54) SYSTEMS AND METHODS FOR TRAIL EDGE PAPER SUPPRESSION FOR HIGH-SPEED FINISHING APPLICATIONS

(75) Inventors: Salvatore A. Abbata, Webster, NY (US); Richard J. Milillo, Fairport, NY (US); Terrance W. Flint, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/248,822

(22) Filed: Feb. 21, 2003

(51) Int. Cl.[7] ..... B65H 31/00

(52) U.S. Cl. ..... 271/213; 271/189; 271/305; 270/58.11; 399/410

(58) Field of Search ..... 271/305, 213, 271/207, 188, 189, 303; 270/58.01, 58.08, 58.09, 58.11, 58.12, 58.13, 58.17, 58.16; 399/410

(56) References Cited

U.S. PATENT DOCUMENTS 4,611,741 A * 9/1986 Wilson ..... 227/99
4,871,158 A 10/1989 May et al.
5,098,074 A * 3/1992 Mandel et al. ..... 270/58.13
5,513,839 A 5/1996 Green
5,642,876 A 7/1997 Ferrara et al.
5,649,695 A 7/1997 Lawrence
5,921,690 A * 7/1999 Shinmachi et al. ..... 400/625
6,003,862 A 12/1999 Russell et al.
6,120,015 A 9/2000 Albright et al.
6,250,628 B1 * 6/2001 Klaus ..... 271/218
6,315,288 B1 * 11/2001 Sugishima et al. ..... 271/303
6,330,999 B2 * 12/2001 Coombs et al. ..... 270/58.18
6,382,615 B1 * 5/2002 Ishiguro et al. ..... 270/58.12
6,394,448 B2 * 5/2002 Suzuki et al. ..... 271/189
6,450,492 B1 * 9/2002 Coombs et al. ..... 270/58.08
6,450,934 B1 * 9/2002 Coombs ..... 493/383
6,581,922 B2 * 6/2003 Kuwata et al. ..... 270/58.11

FOREIGN PATENT DOCUMENTS

JP 08225227 A * 9/1996 ..... B65H/31/34

OTHER PUBLICATIONS

U.S. patent application Ser. No. 10/361,345, Milillo et al., filed Feb. 2003.
U.S. patent application Ser. No. 10/604,013, Milillo et al., filed Jun. 2003.
U.S. patent application Ser. No. 10/249,644, Brumberger et al., filed Apr. 2003.

* cited by examiner

*Primary Examiner*—Patrick Mackey
(74) *Attorney, Agent, or Firm*—Oliff & Berridge, PLC

(57) ABSTRACT

A paper sheet finishing system includes a sheet guiding mechanism having nip rollers to transport a sheet forward, at least one diverter gate through which the sheet passes when the at least one diverter gate is open, and a temporary compiler to support the sheet after the sheet passes the at least one diverter gate, a diverter member to travel in conjunction with the at least one diverter gate, and at least one rear suppressor member connected to the diverter member to push a trailing edge of the sheet forward and pitch a leading edge of the sheet downward after the sheet controllably descends past the temporary compiler with reduced flutter and improved positioning during compilation of the sheets.

15 Claims, 9 Drawing Sheets

SYSTEMS AND METHODS FOR TRAIL EDGE PAPER SUPPRESSION FOR HIGH-SPEED FINISHING APPLICATIONS

BACKGROUND OF THE INVENTION

1. Field of Invention

This invention relates to controlling sheet placement in finishing devices.

2. Description of Related Art

Devices that process sheets of paper, such as high-speed printers, digital copiers and photocopiers, often require finishing operations to be performed. Such a finishing device causes the paper sheets to be deposited in manner either selected by the user or in a default fashion.

Many finishing devices and sheet stacking devices are known in the sheet handling equipment industry, and involve collating or stacking sheets into sets of sheets and finishing each set of sheets by stapling or binding prior to depositing the finished sets of sheets onto a collection tray. Commercially-available designs for finishing devices are currently either too slow for efficient use in high-speed photocopiers, or present an excessive footprint and thereby consume greater volume and surface area in an office space than is desirable.

Conventional finishing devices convey paper sheets horizontally to control their travel for processing. Such configurations require considerable volume for the mechanisms to controllably move the paper sheets. Finishing devices having vertical configurations present either uneven stacking from flutter as the sheets drop or require volume-intensive mechanisms to control the descent of the sheets.

SUMMARY OF THE INVENTION

A high-speed finishing device confined to a small footprint requires that the aerodynamic flutter of the incoming sheets be controlled. A sheet passes through one of a series of diverter gates, depending on the size of the sheet. As the sheet is ejected through a diverter gate, the sheet drops onto a retracting temporary compiler structure.

This invention provides devices and methods for controllably dropping a sheet in a finishing device, such as from an image-forming device.

This invention separately provides devices and methods for reducing flutter in dropped sheets.

This invention separately provides devices and methods for reducing drop time in dropped sheets.

This invention separately provides devices and methods for suppressing forward and rearward motion of dropped sheets.

In various exemplary embodiments, the sheet passes through a retracting temporary compiler structure and continues its descent. At the same time, rear paper suppressor structures provided on a diverter assembly swing down and forward to push the trailing edge of the sheet forward, preventing rearward motion of the sheet. Front paper suppressor slats or baffles provided on a front dampener swing down and backwards to intercept the leading edge of the sheet. These baffles operate to prevent the sheet from moving past the front register gate and to pitch the leading edge of the sheet downward. This enables the sheet to stack evenly on the collection tray after passing under the retracting temporary compiler.

In various exemplary embodiments, the diverter assembly for the rear paper edge suppressor slats can be positioned by a diverter gate positioning motor through a gate belt suspended between two pulleys. In various exemplary embodiments, the rear paper edge suppressor slats are swung by a trail edge suppression drive motor through a positioning system driven by a drive motor through a clutch.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the methods of this invention will be described in detail with reference to the following figures, wherein.

DETAILED DESCRIPTION OF EXEMPLARY EMBODIMENTS

Figure 1:
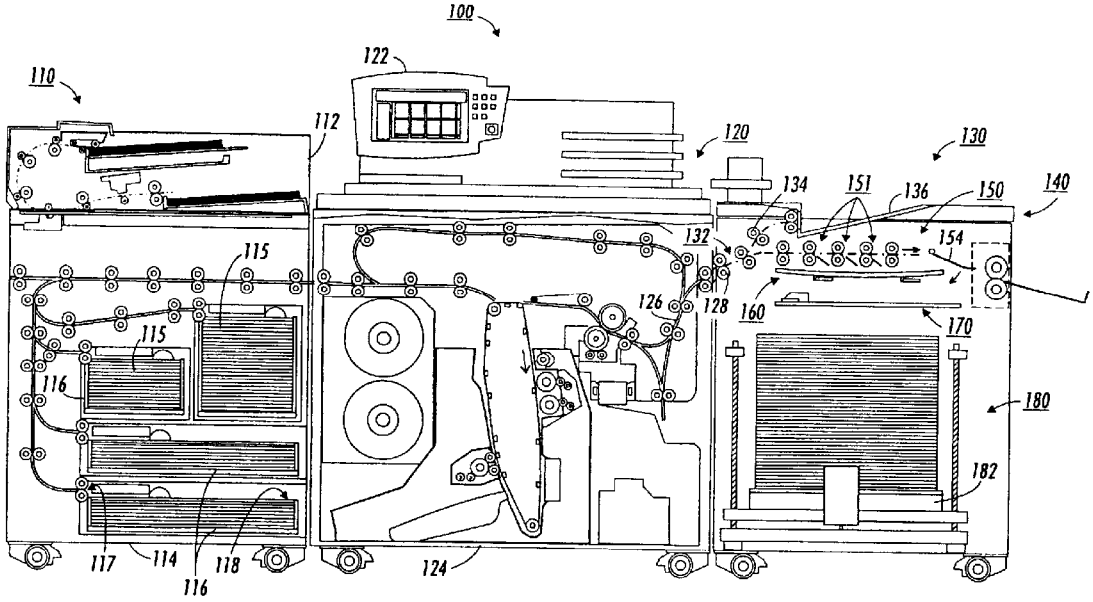
FIG. 1 is an elevation view of one exemplary embodiment of a document handling apparatus usable with the systems and methods according to this invention.

A high-speed finishing device confined to a small footprint requires that the settling time of the trailing edge of incoming sheets be controlled. In particular, such control requires paper sheets to exhibit specific and repeatable aerodynamic behavior. In various exemplary embodiments of the finishing device in which the systems and methods according to this invention are usable, a sheet of paper is fed horizontally into the finishing device and passes between pairs of rollers, called nips, to control the velocity of the sheet through the finishing device.

The sheet passes through one of a series of diverter gates. The diverter gate through which a given sheet passes is selected based on the length of the sheet. The diverter gates are arranged in sequence with the first diverter gate for the longest sheets, and progressing downstream towards the last diverter gate for the shortest sheets. The sheet is ejected through the selected diverter gate, and the sheet travels forward while dropping.

As the sheet passes the selected diverter gate, the trailing edge is pushed by a diverter paddle carried by or attached to a diverter assembly. The sheet drops until the sheet rests on a temporary compiler whose travel arms are extended inward. The travel arms of the temporary compiler subsequently retract outward, causing the sheet to resume its descent. Aerodynamic forces produced by motion of air under the sheet cause the sheet to flutter as the sheet drops. The uneven motion imparted by flutter affects each sheet slightly differently. Consequently, as the sheets are deposited on top of one another, the sheets will stack unevenly. The ragged appearance of the stack is labeled "inset registration" and results from misalignment between interleaving sheet edges.

To suppress this flutter, the downward and forward transit of the sheet must be carefully controlled. As the sheet passes through the retracting temporary compiler and continues its descent, baffles or front paper suppressor slats on a front dampener swing down and backward to intercept the leading edge of the sheet. The front paper suppressor slats cause the leading edge of the sheet to pitch downward and prevent the sheet from moving past a register gate. Also, one or more rear paper edge suppressor slats on the diverter assembly swing down and forward to push the trailing edge of the sheet.

The downward motion of the sheet displaces air from the bottom of the sheet. The sheet is positioned over a shutter platform between the register gate and a rear tamper. The rear tamper moves fore and aft above the shutter platform. If the sheet bounces off the register gate or is not pushed forward to reach the register gate, the sheet can hang above the rear tamper. This prevents the sheet from being pushed further downward and causes stacking delays and potential jamming of sheets. Consequently, the rear paper edge suppressor slats or suppressors control the movement of the trailing edge of the sheet. The rear paper edge suppressor slats thus enable the sheet to be properly aligned on a collection tray past the shutter platform.

The diverter assembly can be positioned by a diverter gate positioning motor through a diverter gate belt suspended between two pulleys. The rear paper edge suppressor slats can be swung by a rear paper suppressor positioning system. The positioning system includes a suppressor drive motor and a diverter belt suspended between two end pulleys. The belt engages the drive motor through a clutch. A transfer pulley between the end pulleys can be positioned to enable the diverter assembly to move forward or rearward depending on the diverter gate through which the sheet passes. As an alternative, the diverter assembly and rear paper edge suppressor slats can be positioned by a single drive motor that operate both the diverter gate belt and the diverter belt. The diverter gate belt and the diverter belt can each be separately engaged through an independent clutch.

These principles can be depicted by the accompanying drawings. FIG. 1 provides an elevation view of a document handling apparatus 100, such as a photocopier having an automatic document handler 110, a transfer station 120 and a finishing device 130. The document handler 110 includes a document source system 112 and a paper supply 114. The document source system 112 feeds an original document to scan the image contents as scan signals. The paper supply 114 contains paper sheets 115 held in supply trays 116 based on their particular sizes. As a sheet 115 is transported from a supply tray 116, the sheet 115 assumes a leading edge 117 and a trailing edge 118.

The transfer station 120 includes a control panel 122 and a transfer station 124. The control panel 122 receives commands from the user to be executed by the document handling apparatus 100. The transfer station 124 receives the scan signals from the document source system 112 to produce a toner image, which is transferred to the sheet 115 of paper or other medium. After the toner image transfer is completed, the sheet 115 is guided by a transfer guide mechanism 126 to exit from the transfer station 124 through an aperture 128 to the finishing device 130.

In various exemplary embodiments, the finishing device 130 contains structures and systems that operate on the sheets 115. A frame assembly 140 supports mechanisms for a diverter gate assembly 150. These mechanisms on the diverter gate assembly 150 distinguish the sheets 115 based on size and shuttle the various individual sheets 115 to further systems for cumulative stacking. A temporary compiler 160 receives and controls the descent of each sheet 115. A finishing station 170 guides the sheet 115 to align all edges of the sheet 115. A collection station 180 provides a platform for stacking the sheets 115. A rear paper suppressor positioning system 190 (shown in FIGS. 6–8) aligns the diverter assembly with a diverter gate through which the sheet 115 passes. These assemblies and systems are described in further detail below.

The sheet 115 is guided into the finishing station 130 by a finisher guide mechanism 132 between nip rollers 134. For small output quantities or for sets of sheets that do not require manipulation, the sheet 115 can be ejected to a bypass output tray 136. Larger output quantities, or sets of sheets requiring further manipulation, require more elaborate stacking operations. For such circumstances, the sheet continues along the finisher guide mechanism 132 to the diverter gate assembly 150.

Figure 4:
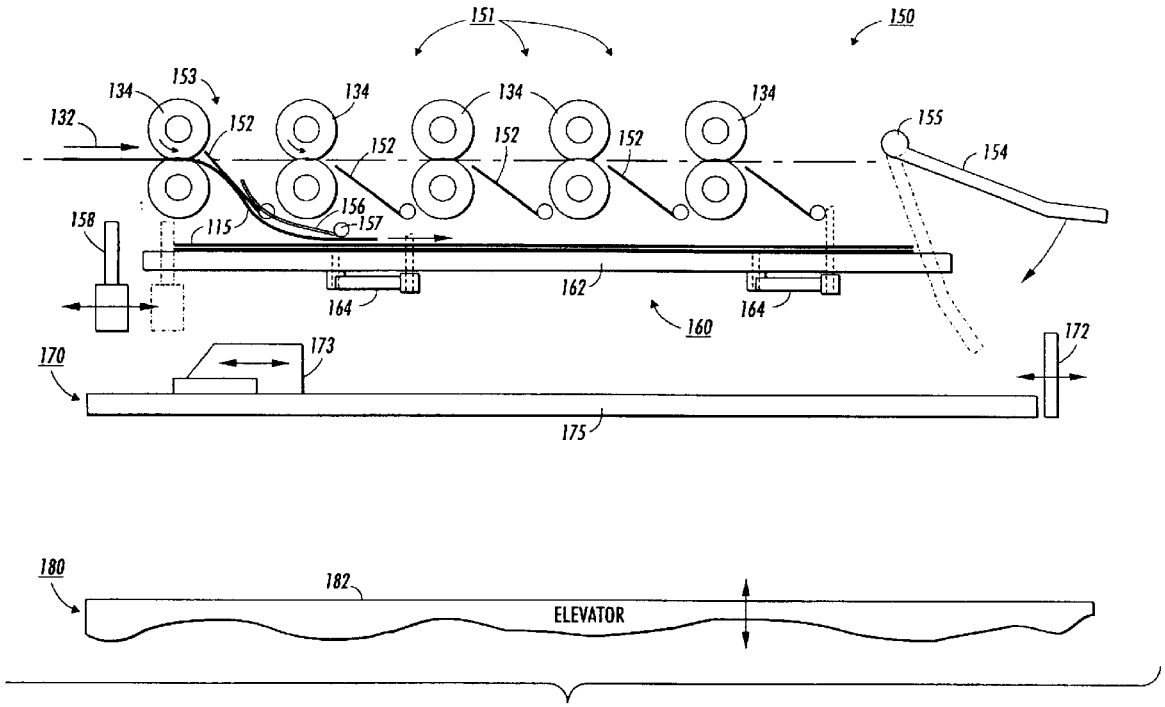
FIG. 4 is an elevation view of one exemplary embodiment of a sheet guide mechanism, with the temporary compiler extended inward, usable with the systems and methods according to this invention.
Figure 5:
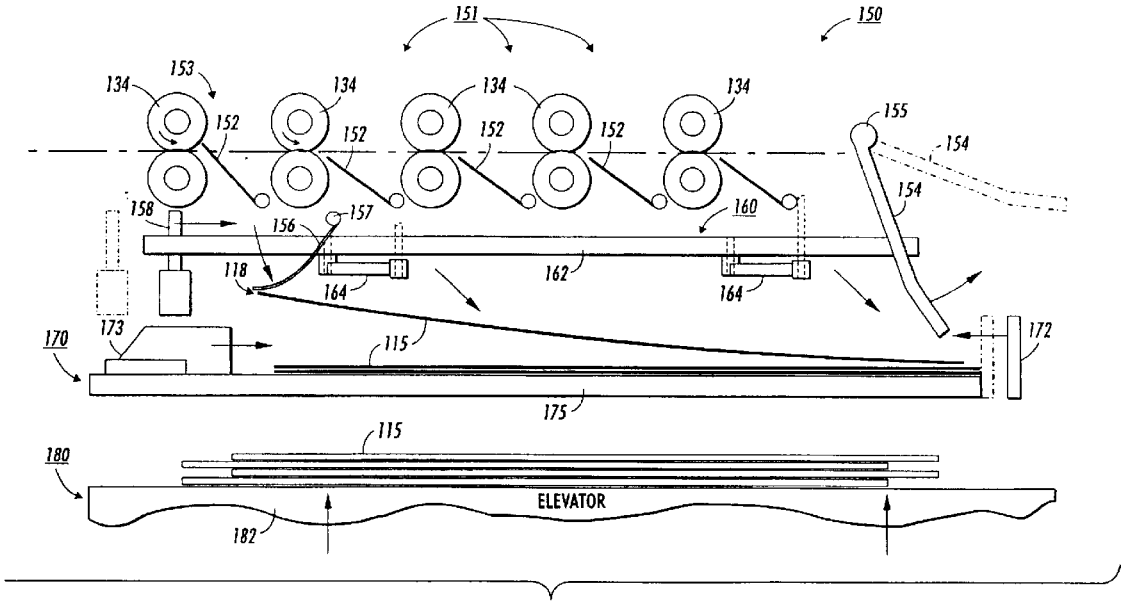
FIG. 5 is an elevation view of one exemplary embodiment of a sheet guide mechanism, with the temporary compiler retracted outward, usable with the systems and methods according to this invention.

The diverter gate assembly 150 includes a series of diverter gates 151, each diverter gate separately opened by diverter gate flaps 152 (shown in FIGS. 4–5). Depending on the length of the sheet 115, an appropriate diverter gate 153 (shown in FIGS. 4–5) is selected from among the series of diverter gates 151. The selected diverter gate 153 opens to allow the sheet 115 to pass through to the temporary compiler 160. In various exemplary embodiments, the diverter gate flaps 152 constrain the leading edge 117 of the sheet 115 while passing through the selected diverter gate 153. In various exemplary embodiments, rear sheet suppressors 156 constrain the trailing edge 118 of the sheet 115.

Figure 2:
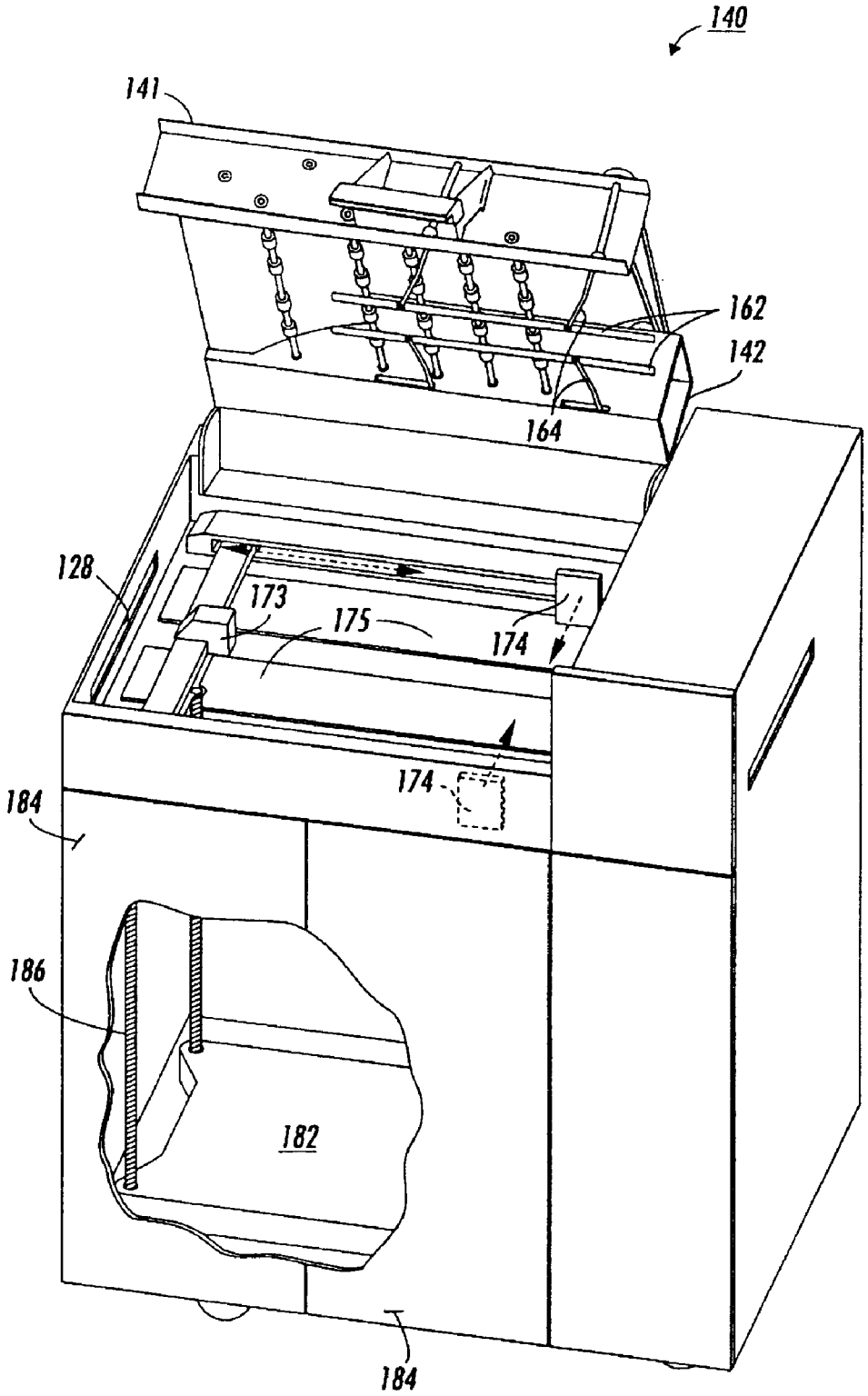
FIG. 2 is an isometric view of one exemplary embodiment of a finishing machine usable with the systems and methods according to this invention.

FIG. 2 shows an isometric view of the finishing device 130 with a frame assembly 140 opened to reveal some of the mechanisms therein. The frame assembly 140 includes frame members 141 and 142 to provide structure for the top of the finishing device 130. After passing through the selected diverter gate 153, the sheet 115 is disposed on the temporary compiler mechanism 160. In particular, the sheet 115 rests on retractable travel arms 162 of the temporary compiler mechanism 160. When the travel arms 162 are retracted by links 164, the sheet 115 drops into the finishing station 170. While descending, the sheet 115 is guided along its edges by register gates 172 (shown in FIGS. 4–5), a trail edge tamper 173 and side tampers 174 until being deposited onto a shuttle platform 175 of the finishing station 170. The shuttle platform 175 includes a number of retractable collection arms. From the shutter platform 175, as the collection arms retract, the sheet 115 can further descend onto a collection tray 182 to stack flush with the edges of preceding sheets 115, as shown through the front doors 184. Threaded posts 186 enable the collection tray 182 to be vertically adjusted.

Figure 3:
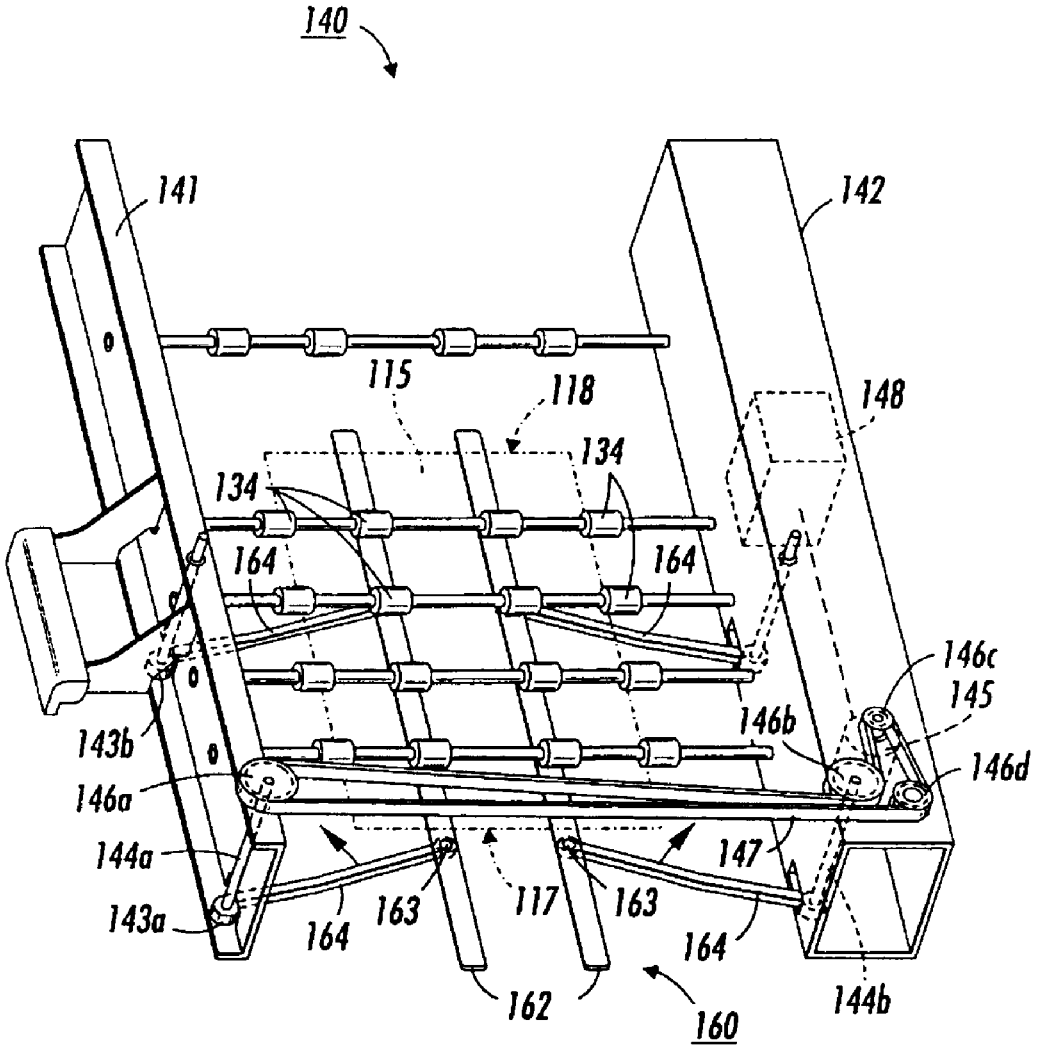
FIG. 3 is an isometric view of one exemplary embodiment of a sheet guide mechanism usable with the systems and methods according to this invention.

FIG. 3 shows, in greater detail, an isometric view of one exemplary embodiment of the sheet guide mechanism 160 between the frame members 141 and 142. The travel arms 162 are shown in the extended position to support the sheet 115. The arm links 164 pivot about hinges 143*a* and 143*b* on the frame members 141 and 142, while the travel arms 162 are connected to the arm links 164 at pin joints 163. The arm links 164 are swung outwardly in arcuate directions (shown by arrows) towards the frame members 141 and 142.

An arm retracting motor 145 is connected to a number of pulleys 146*a*, 146*b* and 146*c* connected by a timing belt 147. The arm retracting motor 145 turns the timing belt 147 around the pulleys 146*a*–146*c* to rotate shafts 144*a* and 144*b*. Rotating the shafts 144*a* and 144*b* pivots the driver hinges 143*a*, causing the follower hinges 143*b* to also pivot, and thereby swing the travel arms 162 and retract towards the frame members 141 and 142. Reversing the direction of the arm retracting motor 145 causes the travel arms 162 to extend away from the frame members 141 and 142. Operation of the retracting motor 145 to swing the arm links 164 is controlled by a controller 148.

FIG. 4 shows an elevation view of the sheet guide mechanism 160 when the travel arms 162 are extended inwardly. The sheet 115 passes between at least some of the nip rollers 134 of the transport assembly 150 and through one of several diverter gates 151, depending on the size of the sheet 115. These diverter gates 151 employ the diverter gate flaps 152, one of which deflects to open the selected diverter gate 153 of the diverter gates 151, allowing the sheet 115 to pass out from the finisher guide mechanism 132. The rear paper suppressors 156 are positioned to avoid obstructing the sheet 115 through the selected diverter gate 153. The sheet 115 descends onto to the travel arms 162 below the diverter gates 151.

FIG. 5 shows an elevation view of the sheet guide mechanism 160 after the travel arms 162 are retracted outwardly. As the travel arms 162 are withdrawn, the sheet 115 drops between the retracted travel arms 162. Front paper edge slats 154 constrain the forward movement of the sheet 115 from being pushed forward of the register gates 172. The front paper edge slats 154 are suspended on a front dampener 1 55 positioned forward of the diverter gate flaps 152 of the selected diverter gate 153. The front paper edge slats 154 can be wires or thin flexible strips.

As the sheet 115 migrates over the travel arms 162, the front paper edge slats 154 swing downward to constrain the forward movement of the sheet 115 from being pushed forward of the register gates 172. At the same time, a diverter paddle 158 (or a paddle wheel) constrains rearward movement of the sheet 115 as the sheet 115 descends from between the retracted travel arms 162. The rear paper suppressors 156 can be wires or thin flexible strips and are connected to a diverter assembly 157. The diverter assembly 157 can be positioned fore and aft along the frame members 141 and 142 depending on which diverter gate 151 becomes the selected diverter gate 153 through which the sheet 115 passes. In various exemplary embodiments, the front dampener 155 can also be attached to the diverter assembly 157.

When the arm links 164 retract the travel arms 162, the sheet 115 drops through the enlarged gap between the travel arms 162. The sheet 115 descends between the travel arms 162 as the arm links 164 pivot towards the frame members 141 and 142. The rear paper suppressors 156 swing downward and impinge against the sheet 115 along or near the trailing edge 118 to push the sheet 115 forward of the trail edge tamper 173. Also, the front paper edge slats 154 pitch the leading edge 117 downward as the sheet 115 drops to the shutter platform 175.

The rear paper suppressors 156 impinge against the sheet 115 along or near the trailing edge 118 to push the sheet 115 forward of the trail edge tamper 173 and to pitch the leading edge 117 downward as the sheet 115 drops towards the shutter platform 175. The trail edge tamper 173 also moves fore and aft along the frame members 141 and 142. By constraining the sheet 115 in forward and aft directions using the rear paper suppressors 156 and the front paper edge slats 154, aerodynamic flutter of the sheet 115 during its descent is minimized. Suppressing flutter enables multiple sheets 115 to fall in a repeatable fashion onto the collection arms of the shutter platform 175 until the stack of sheets 115 is compiled as instructed via the control panel 122. The collection arms on the shuttle platform 175 then retract to allow the completed stack of sheets 115 to drop onto the collection tray 182.

Figure 6:
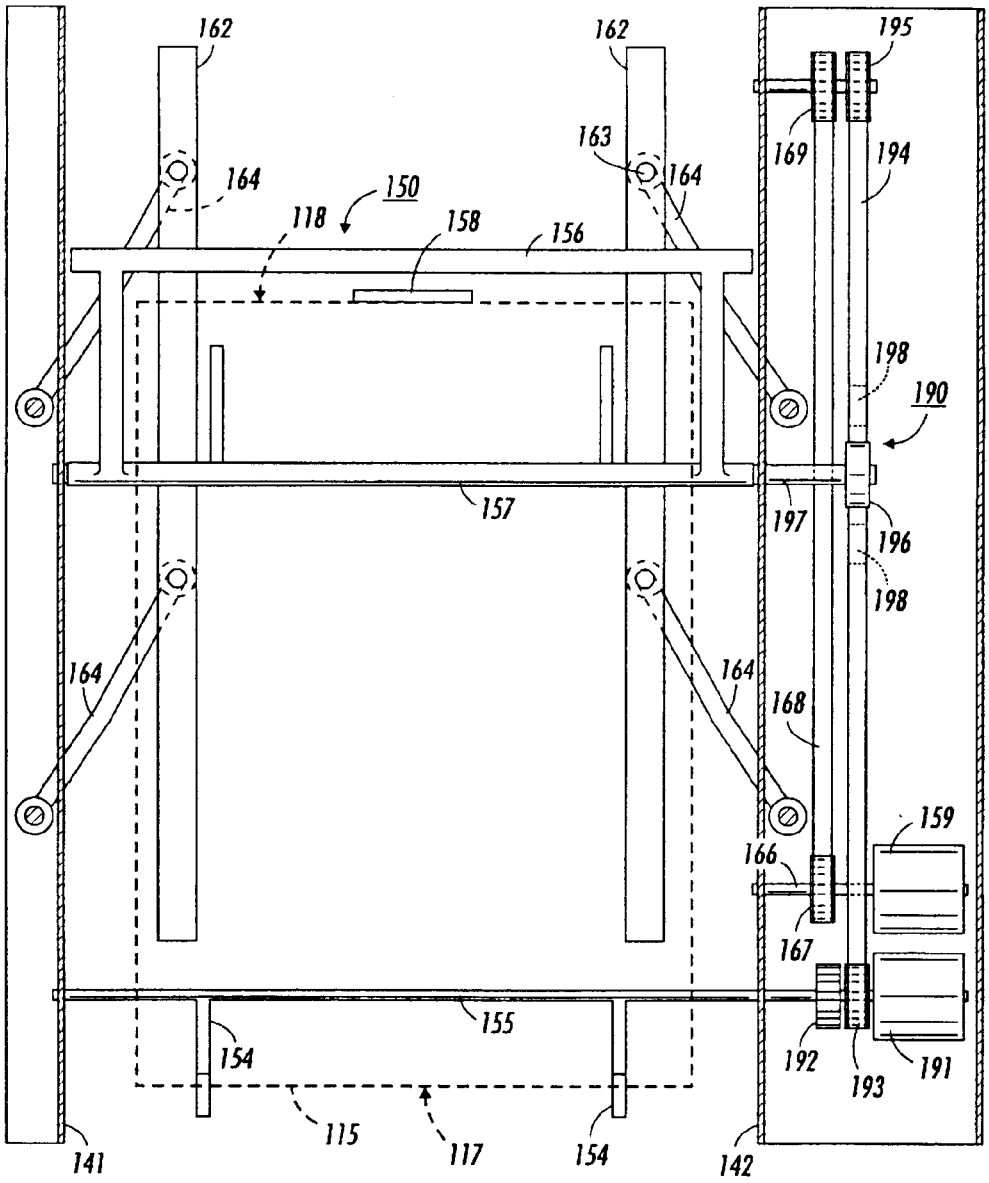
FIG. 6 is a plan view of one exemplary embodiment of a sheet guide mechanism, with the temporary compiler extended inward, usable with the systems and methods according to this invention.
Figure 7:
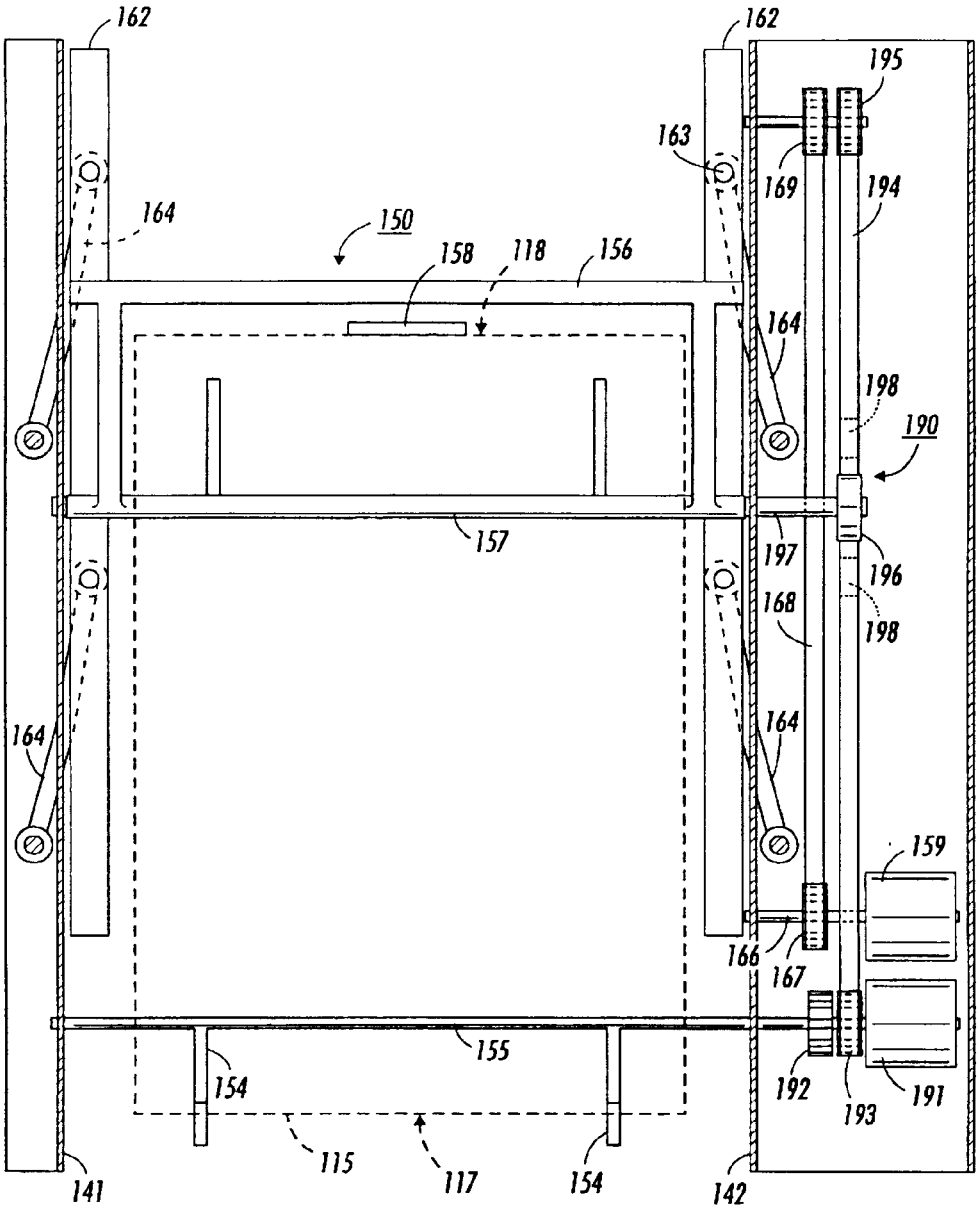
FIG. 7 is a plan view of one exemplary embodiment of a sheet guide mechanism, with the temporary compiler retracted outward, usable with the systems and methods according to this invention.

FIG. 6 shows a top plan view of the sheet guide mechanism 160 including the diverter assembly 157 and the front dampener 155 over the sheet 115 with the travel arms 162 supporting the sheet 115. FIG. 7 shows a top plan view of the diverter assembly 157 and front dampener 155 above the sheet 115 with the travel arms 162 retracted outward.

A positioning motor 159 operates to swing the diverter gate flaps 152 for the selected diverter gate 153. The positioning motor 159 rotates a drive shaft 166 on which a drive pulley 167 is connected. A positioning belt 168 connects the drive pulley 167 to a follower pulley 16. The diverter assembly 157 and front dampener 155 can be moved fore and aft along the frame member 142 by the rear paper suppressor positioning system 190. The position of the diverter assembly 157 and front dampener 155 can be adjusted by the controller 148 to align the diverter assembly 157 with the selected diverter gate 153 through which sheet 115 passes.

In various exemplary embodiments, the rear paper suppressor positioning system 190 is powered by a rear paper suppressor drive motor 191 and is controllably engaged by a diverter clutch 192. The positioning system 190 swings the rear paper suppressors 156. Alternatively, power can be supplied by the diverter gate positioning motor 159 with a clutch to provide for independent pivoting of the rear paper suppressors 156 and translation of the diverter assembly 157.

A diverter gate 151 can often accommodate several paper sizes having modest differences in length. For example, letter size and A4 size sheets can pass through the same diverter gate. In various exemplary embodiments, the rear paper suppressors 156 can be positioned to align with the selected diverter gate 153 through which the sheet 115 passes and with the specific paper length associated with the selected diverter gate 153.

Figure 8:
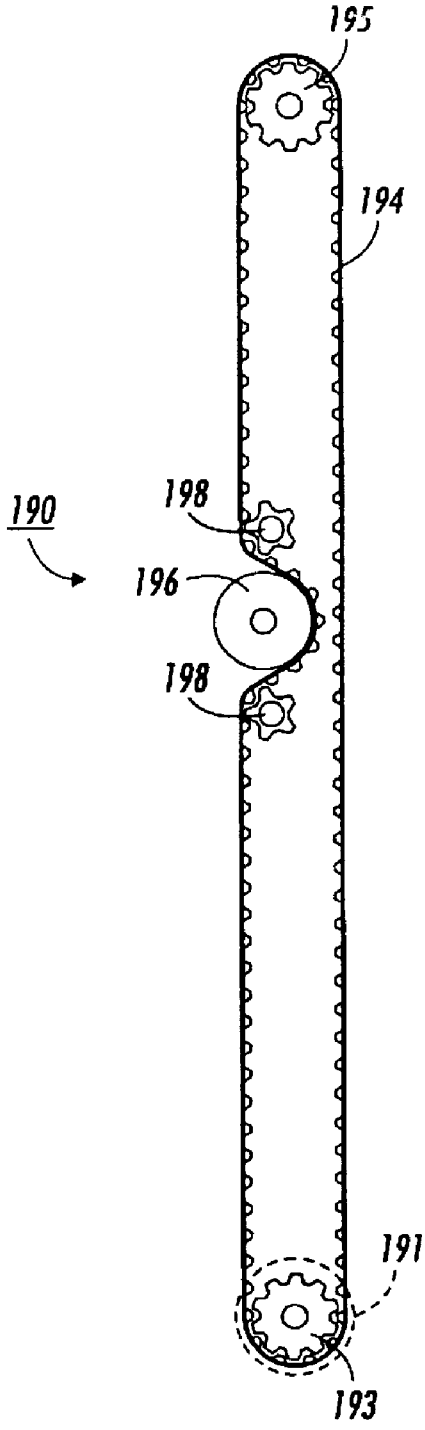
FIG. 8 is an elevation view of one exemplary embodiment of a trail edge dampening positioning system usable with the systems and methods according to this invention.

FIG. 8 shows an elevation view of the trail edge dampening positioning system 190. When the diverter clutch 192 is engaged, the drive motor 191 powers a drive pulley 193. The drive pulley 193 turns a suppressor belt 194 suspended between the drive pulley 193 and an end pulley 195. A transfer pulley 196 is positioned between the drive pulley 193 and the end pulley 195. A diverter link 197 pivotably connects the rear paper suppressors 156 to the transfer pulley 196 that is suspended between idler wheels 198. The drive pulley 193 and the end pulley 195 remain in a fixed position along the frame member 142. The transfer pulley 196 and the idler wheels 198 can travel fore and aft along the frame member 142.

Figure 9:
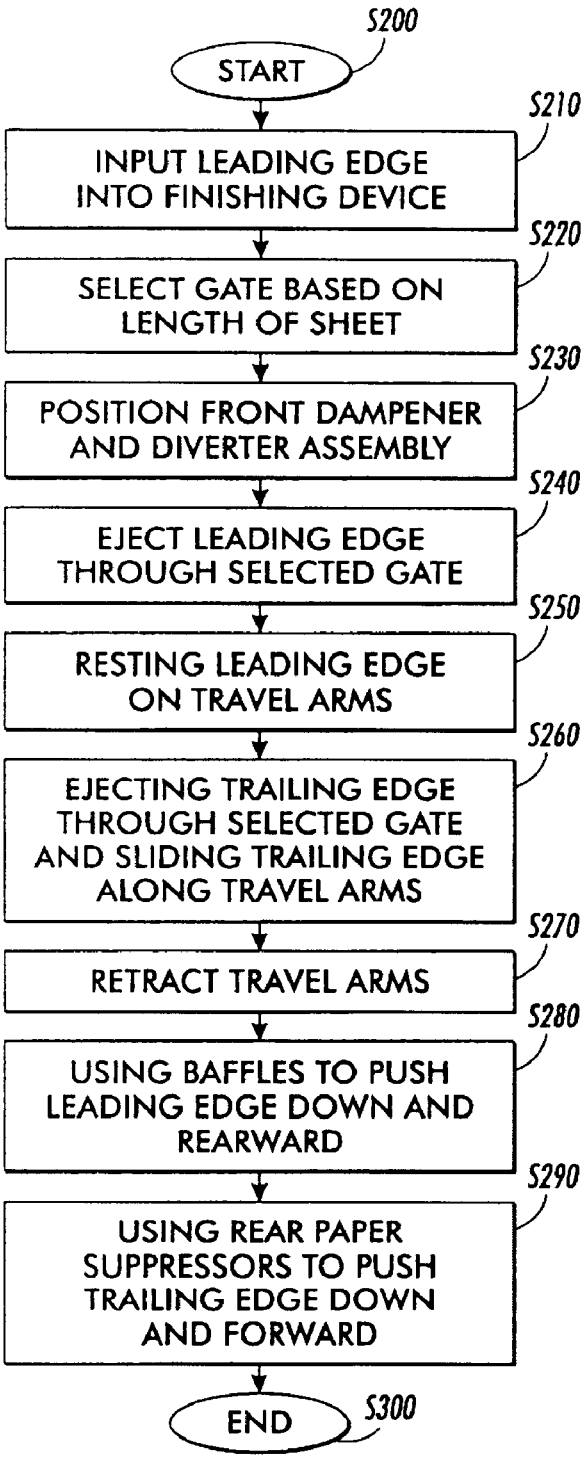
FIG. 9 is a flowchart outlining one exemplary embodiment of a method for suppressing trailing edge positioning of a sheet within a finishing device according to this invention.

The sequence by which the sheet 115 passes through the finishing device 130 to the collection tray 182 can be controlled by the controller 148. FIG. 9 is a flowchart outlining one exemplary embodiment of a method for controlling the sheet 115 in the finishing device 130. Beginning in step S200, operation continues to step S210, where the leading edge 117 of the sheet 115 enters the finishing device 130 through the aperture 128 along the finisher guide mechanism 132. Next, in step S220, one of the diverter gates 151 is selected as the selected gate 153 based on the length of the sheet 115. Then, in step S230, the front dampener 155 and the diverter assembly 157 are positioned along the frame member 142 corresponding to the selected diverter gate 153. Operation then continues to step S240.

In step S240, the leading edge 117 of the sheet 115 exits through the selected diverter gate 153 at the corresponding nip roller 134. Next, in step S250, the leading edge 117 passes along the temporary compiler mechanism to rest on the travel arms 162. Next, in step S260, the trailing edge 118 of the sheet 115 exits the selected diverter gate 153. In various exemplary embodiments, the sheet 115 slides along the travel arms 162. Operation then continues to step S270.

In step S270, the travel arms 162 are then retracted by the links 164, allowing the sheet 115 to drop between the travel arms 162. In various exemplary embodiments, in step S280, when the sheet 115 is in free fall, the front paper edge slats 154 on the front dampeners 155 rotate or swing downward to push the leading edge 117 of the sheet 115 downward. The front paper edge slats 154 cause the leading edge 117 of the sheet 115 to pitch downward, orienting the sheet 115 to exhibit a negative drop angle relative to horizontal. The sheet 115 has inertia from forward momentum provided by the nip rollers 134 and downward momentum at the leading edge 117 from the front paper edge slats 154 on the front dampener 155, while in gravity-induced descent. With the leading edge 117 lower than the trailing edge 118, the sheet 115 drops between the register gates 172 and the trail edge tamper 173. Then, in step S290, before the trailing edge 118 of the sheet 115 begins to flutter, as a result of the aerodynamic forces under the sheet 115, the rear paper suppressors 156 rotate or swing downward. Additional momentum can be transferred to the sheet 115 if the tips of the rear paper suppressors 156 are coated with a highly frictional material. Operation then continues to step S300, where operation of the method terminates. The sheet 115 now falls faster and forward toward the shutter platform 175 with much greater accuracy and repeatability.

The controller 148 can be implemented on a general purpose computer, a special purpose computer, a programmed microprocessor or microcontroller in peripheral integrated circuits, an ASIC or other integrated circuit, a digital signal processor, a hard wired electronic or logic circuit such as a discrete element circuit, a programmable logic device such as a PLD, PLA, FPGA or PAL, or the like. In general, any device, capable of implementing a finite state machine that is in turn capable of implementing a sequence of instructions for controllably positioning the travel arms 162, the front dampener 155 and the diverter assembly 157 can be used to implement the controller 148.

While this invention has been described in conjunction with exemplary embodiments outlined above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. A trail edge control device for controlling a sheet position in a sheet finishing system that includes a temporary compiler, comprising:

a diverter member connecting to a diverter positioning system; and at least one rear suppressor member connected to the diverter member, the rear suppressor member usable to push a trailing edge of the sheet forward after the sheet descends past the temporary compiler.

2. The trail edge control system according to claim 1, further comprising a front dampener including at least one baffle member that pitches a leading edge of the sheet downward and that constrains movement of the sheet in the forward direction.

3. The trail edge control system according to claim 1, further comprising a diverter paddle connected to the diverter member, wherein the diverter paddle constrains movement of the sheet in a rearward direction.

4. The trail edge control system according to claim 1, wherein the diverter positioning system includes:

at least one fixed pulley associated with the diverter member, a movable pulley translatable along at least one diverter gate, and a diverter belt that connects the movable pulley and the at least one fixed pulley, wherein the movable pulley translates the diverter member along a direction of the diverter belt when rotated, and rotates the at least one rear suppressor member when rotated.

5. The trail edge control system according to claim 1, further comprising: a drive motor; and a diverter positioning clutch that controllably connects the drive motor to the diverter positioning system.

6. The trail edge control system according to claim 5, further comprising:

a diverter gate actuator usable to actuate the at least one diverter gate; and a diverter gate operating system connected to the diverter gate actuator, the diverter gate operating system including:

a diverter gate drive pulley, a diverter gate follower pulley, a diverter gate actuating belt that connects the diverter gate drive pulley and the diverter gate follower pulley, and a diverter gate clutch that controllably connects the diverter drive motor to the diverter gate operating system.

7. A sheet finishing system comprising:

a sheet guiding mechanism including:

nip rollers usable to transport a sheet in a forward direction, at least one diverter gate, through which the sheet is selectively able to pass, and a temporary compiler usable to support the sheet diverted by the at least one diverter gate;

a diverter member connecting to a diverter positioning system; and at least one rear suppressor member connected to the diverter member usable to push a trailing edge of the sheet in the forward direction after the sheet descends past the temporary compiler.

8. The sheet finishing system according to claim 7, further comprising a front dampener, including at least one baffle member usable to pitch a leading edge of the sheet downward and to constrain movement of the sheet in the forward direction.

9. The sheet finishing system according to claim 7, further comprising a diverter paddle connected to the diverter member, wherein the diverter paddle constrains movement of the sheet in a rearward direction.

10. The sheet finishing system according to claim 7, wherein the diverter positioning system further includes:

at least one fixed pulley associated with the diverter member, a movable pulley translatable along the at least one diverter gate, and a diverter belt that connects the movable pulley and the at least one fixed pulley, wherein the movable pulley translates the diverter member along a direction of the diverter belt when rotated, and rotates the at least one rear suppressor member when rotated.

11. The sheet finishing system according to claim 10, further comprising:

a drive motor; and a diverter clutch that controllably connects the drive motor to the diverter positioning system.

12. The sheet finishing system according to claim 11, further comprising:

a diverter gate operating system connected to a diverter gate actuator, the diverter gate operating system including:

a diverter gate actuating belt, a diverter gate drive pulley, a diverter gate follower pulley, and a diverter gate clutch, wherein the diverter gate actuating belt connects the diverter gate drive pulley and the diverter gate follower pulley, and the diverter gate clutch controllably connects the drive motor to the diverter gate operating system.

13. A method for controlling a sheet position in a sheet finishing system, comprising:

transporting a sheet in a forward direction;

passing the sheet through one of a plurality of diverter gates when that one diverter gate is open;

supporting the sheet on a temporary compiler after the sheet passes that one diverter gate;

moving a diverter member to travel in conjunction with that one diverter gate; and pushing a trailing edge of the sheet in the forward direction after the sheet descends past the temporary compiler.

14. The method according to claim 13, further comprising pushing a leading edge of the sheet in a downward direction to prevent movement of the sheet in the forward direction past a register gate.

15. The method according to claim 14, further comprising constraining movement of the sheet in a rearward direction as the sheet passes through that one diverter gate.

* * * * *